US005709072A

United States Patent [19]

Hasenack et al.

[11] Patent Number: 5,709,072

[45] Date of Patent: Jan. 20, 1998

[54] METHOD OF PRODUCING COLORED SHORT STAPLE FIBER YARN OF COTTON AND/OR SYNTHETICS

[75] Inventors: Klaus Hasenack; Peter Krummenast; Harald Kirchner; Markus Spieker, all of Wuppertal, Germany

[73] Assignee: "WFG" Colcoton-Garn Hasenack & Co., Wuppertal, Germany

[21] Appl. No.: 612,724

[22] Filed: Mar. 8, 1996

[30] Foreign Application Priority Data

Mar. 19, 1995 [DE] Germany ..... 195 08 633.3

[51] Int. Cl.[6] ..... D01H 7/24; D01H 1/04

[52] U.S. Cl. ..... 57/67; 57/362; 57/1 R; 8/154; 68/189; 68/198; 242/118.11; 242/118.62; 242/118.3

[58] Field of Search ..... 57/67, 362, 1 R; 242/118, 118.1, 118.11, 118.3, 118.62, 118.61; 8/154, 155, 155.1, 155.2; 68/189, 198

[56] References Cited

U.S. PATENT DOCUMENTS

| | | | |
|---|---|---|---|
| 3,389,546 | 6/1968 | Reeder et al. | 57/67 |
| 3,878,575 | 4/1975 | Wedler | 8/155.1 |
| 3,899,817 | 8/1975 | Clifford et al. | 29/234 |
| 3,960,341 | 6/1976 | Thelen | 242/118.1 |
| 3,964,153 | 6/1976 | Clifford et al. | 29/427 |
| 3,964,691 | 6/1976 | Pearce et al. | 57/67 X |
| 4,598,880 | 7/1986 | Brutel et al. | 242/118.1 X |
| 5,155,989 | 10/1992 | Frey et al. | 57/327 |

FOREIGN PATENT DOCUMENTS 41 42 110 6/1993 Germany .

*Primary Examiner*—Daniel P. Stodola
*Assistant Examiner*—Tina R. Taylor
*Attorney, Agent, or Firm*—Herbert Dubno

[57] ABSTRACT

A method of dyeing of short-staple fiber of cotton, synthetics or blends thereof in which the sliver if formed into a roving package on a perforated sleeve in a flyer frame with a slight twist and with a uniform winding density and the roving package is then subjected to dyeing and the dyed roving package is then delivered directly to the final spinning frame. The dyeing of the flyer slubbing is possible because of a package before final spinning, but not in the flock form with a stability of the flyer slubbing afforded by the slight twist imparted thereto in the flyer frame.

4 Claims, 4 Drawing Sheets

METHOD OF PRODUCING COLORED SHORT STAPLE FIBER YARN OF COTTON AND/OR SYNTHETICS

FIELD OF THE INVENTION

Our present invention relates to a method of and to devices for producing colored short staple fiber yarn from cotton and/or synthetics.

BACKGROUND OF THE INVENTION

Colored short-staple fiber yarns, especially cotton yarns, have been produced basically in two ways heretofore. In a first technique, the crude cotton is dyed in the block (flock dying) and after producing the sliver and a flyer slubbing or roving which is then spun. This process provides coloring at the earliest possible stage in the process and is therefore a basis for the shortest fabrication process for colored cotton yarns since it has a minimum number of process steps. In practice, however, this process is practical only for dying of lots of say ten metric tons of cotton. As a consequence, the utility of this process is limited since such large yarn lots of a single color are seldom required.

In a second process, the spun raw yarn is dyed on cross reels (cross-reel dying) or in discrete turns on warp beams. Cross-reel dyeing is able to be used more flexibly than the previously described approach and, for example, for lots of about one kg of yarn to say 12 kg of yarn, depending upon requirements. However this approach requires multiple respoolings of the yarn which is a time-consuming and labor-intensive operation. Customarily, the raw white yarn is supplied with a dye winding on paper sleeves. The yarn must then be respooled on spooling machines onto cylindrical or conical dyeing spools, whereupon cross-reel dying is effected and the yarn packages on the dyeing spools must be respooled onto paper sleeves. During these operations, the product may deteriorate and thus the final product may have less than the desired quality.

However, because of the greater flexibility of the latter process, it has been to date the process most widely used for the production of colored short-staple yarns from cotton, synthetic fibers or blends of cotton with synthetic fibers.

OBJECTS OF THE INVENTION

It is, therefore, the principal object of the present invention, to provide an inexpensive process which can produce very high quality colored short-staple fiber yarns in economically sized lots without the drawbacks of earlier systems as described.

It is another object to provide devices facilitating the use of the improved process.

Still another object of the invention is to provide an improved process for dyeing short-staple fiber yarn of cotton, synthetics without the disadvantages of earlier techniques.

SUMMARY OF THE INVENTION

These objects and others which will become apparent hereinafter are attained, in accordance with the invention, in a process or method whereby the short-staple fiber yarn of cotton and/or synthetics, i.e. cotton, synthetic fibers or blends thereof, are dyed by winding the sliver or a loose roving as a flyer slubbing to a roving body with a uniform winding density upon a perforated dyeing sleeve, dyeing the roving body on the dyeing sleeve and then supplying the dyed flyer slubbing directly to a spinning machine.

More particularly, the method of the invention can comprise the steps of:

(a) providing a sliver of at least one fiber selected from the group which consists of short staple fiber cotton, synthetics or blends thereof;

(b) flyer-winding the sliver as a slight twist flyer slubbing into a roving body with a uniform turn density on a perforated dyeing sleeve;

(c) dyeing the roving body by passing a dyestuff through the roving body and perforations in the sleeve; and (d) directly following the dyeing of the roving body spinning the slight twist flyer slubbing thereon into a yarn on a spinning machine.

In this case, the dyeing of the cotton, synthetics or blend can be effected prior to the spinning step although no longer in the flock, but rather the dyeing is effected on a dyeing spool (flyer spool) in which the sliver is provided with a slight twist on a flyer yarn or roving or loose flyer slubbing. By supplying the flyer slubbing directly to the spinning machine, the last operating step prior to spinning is the dyeing or any after-treatment which is associated with or customarily part of the dyeing process. The dyeing of the invention can include treatment of the roving body with the dyestuff, any rising, drying and after-treatment steps common in the dyeing of short-staple fiber cotton, synthetics or blends.

The reference to a uniform winding density is intended to indicate that the number of turns of the flyer slubbing applied to the perforated tube or sleeve per unit length thereof remains constant in the winding of the entire roving body as much as possible.

The process of the invention has a number of advantages. For example, the numerous respoolings required in the cross-reel dyeing technique are no longer necessary and in particular respoolings prior to dyeing and subsequent to dyeing are no longer necessary.

The cotton yarn can be handled in small lots and thus free from the problems which have been encountered heretofore where large lots had to be dyed and since the dyeing is effected immediately prior to the spinning of the yarn, the spinning ensures a further blending of the colored cotton fibers which has been found to yield an improved colored tone quality of the yarn.

In the manufacture of core yarns or so-called soft core yarns (cotton yarn with elastic synthetic cores), the method of the invention provides the further advantage that the elastic core is introduced into the yarn after the dyeing of the flyer slubbing in the spinning process and thus elasticity differences as arise with cross-reel dyeing no longer occur.

It has also been found, quite surprisingly, that a comparison with a dyed core yarn produced by the cross-reel dyeing with a core yarn produced by the present invention by the core is introduced during the spinning process after the dyeing of the roving body, that the yarn value of the latter in terms of the IPI values and the USTER-V% values are better than those of the cross-reel dyed product and the raw yarn values of the core yam itself. However, the improvement is not yet fully understood.

It should be mentioned that the dyeing of yarn prior to spinning is itself not new. For example, as described in the German Dyeing Journal of Köln, Pehlke, some 25 years ago on 7–9 May 1970 described the production of fiber yarn and its dyeing for wool, wool blends and yarn with high bulk fibers, i.e. yarns which are not combed as sliver or slubbing (see DE-Z Textil-Industrie 72 (1970), Vol. 9, P. 690–692).

The dyeing of a combed product has been long practiced in the field of wool and other long-staple fiber yarns. For example, in the combed product referred to, "bumps" have been dyed in dyers previously. The product, however, is a colored long-staple fiber yarn and the technique has not been employed for the dyeing of cotton yarns and other short-staple fiber yarns similar thereto, since these have involved completely different fabrication processes and stations. The optimal dyeing of wool depends upon the history of the formation of the combed product and the dyeing operation and the finishing steps and, finally, upon the spinning process.

The application of techniques which have been used for wool and long-staple fiber yarns to cotton and short-staple fiber synthetics or blends thereof has not been found to be practical heretofore for a variety of reasons, not the least of which is the lack of stability of the combed product or sliver of such short-staple fiber material.

The invention, therefore, is based in part upon our discovery that the problems which have hitherto been conceived as barring the dyeing of loose collections of combed short-staple fibers, can be overcome by imparting a slight twist thereto in forming the flyer slubbing on the sliver on the perforated tubes to provide the roving bodies or packages which are dyed according to the invention. Thus one difference from prior art techniques utilized for the dyeing of combed fiber is the fact that the invention treats short-staple fibers of cotton and synthetics. A second difference is that the invention treats the short-staple fibers in a more stable state, i.e. as a flyer slubbing with a slight twist. Still another difference is that the flyer slubbing is treated on a sleeve or core which is perforated and on which the slubbing has been applied in a flyer frame or the like in a roving package and directly before the final spinning of the slubbing to a complete thread.

Neither the earlier processes for producing dyed combed wool or other long-staple fiber yarns nor the process described by Pehlke are capable of providing a simple, inexpensive and rational process for producing high quality short-staple yarns as are produced by the invention. Furthermore, the dyeing according to the invention does not introduce any significant number of additional processing steps or machine stations since the short-staple fibers can be dyed directly as a roving body on the flyer cores upon which they are wound in the flyer frame, completely avoiding any need for cross-reel intervention.

According to a feature of the invention, the sliver receives a twist count of substantially 40 to 60 and preferably 50 to 55 turns per meter in forming the slight twist flyer slubbing. Furthermore, the sliver is preferably wound in a flyer roving frame directly upon a flyer sleeve forming the dyeing sleeve.

A dyeing sleeve for carrying out the process can comprise part of a winding assembly.

According to the invention, a winding assembly for receiving a roving body of a slight twist flyer slubbing wound with a uniform turn density and composed of at least one fiber selected from the group which consists of short staple fiber cotton, synthetics of blends thereof, the winding assembly preferably comprising:

a flyer sleeve on which a roving bobbin can be wound in a roving flyer frame and having a base provided with formations for rotatable entrainment of the flyer sleeve, a cylindrical shank connected to the base and extending upwardly therefrom and an end piece on the shank having a conical configuration; and a dyeing sleeve in a form of a perforated tube of an internal diameter fitting over, frictionally engaging and hugging shank of the flyer sleeve for receiving the roving body whereby the roving body can be dyed by removal of the body and the dyeing sleeve from the flyer sleeve and passing a dyestuff through the roving body and perforations in the dyeing sleeve.

In this embodiment, the inner diameter of the dyeing sleeve is, with a slight underdimensioned, matched to the outer diameter of a conventional flyer sleeve so that it can be held on the flyer sleeve in a friction-tight clamping manner during the flyer frame application of the flyer slubbing to the dying sleeve. As a consequence, the roving package can be formed on the dyeing sleeve while the latter is on a conventional flyer sleeve without any significant increase in cost. The flyer sleeve can be supplied as such that the dyed package thereon directly to the spinning machine so that no change in the latter is required. During the dyeing, if the flyer sleeve is not perforated, the dyeing sleeve can be pulled off the flyer sleeve and replaced on a flyer sleeve for spinning.

In an alternative construction a flyer sleeve can be used directly, without a separate dyeing sleeve and then comprises:

a base provided with formations for rotatable entrainment of the flyer sleeve, a perforated cylindrical tubular shank connected to the base and extending upwardly therefrom, and an endpiece on the shank having a conical configuration, the roving body being wound on the perforated tubular cylindrical shank, whereby the roving body can be dyed by passing a dyestuff through the roving body and perforations in the perforated cylindrical tubular shank.

In this latter case, the conical head and the base provided with the means for entraining the flyer sleeve in rotation at the flyer or spinning frame spindles, can be provided with means for releasably coupling them to the tubular shank of the flyer sleeve which can be perforated.

This means can include a screw thread means or a bayonet coupling means.

According to a feature of the invention, the roving package can have a cylindrical central portion and conical or frustoconical end portions taper away from the cylindrical portion on the cylindrical shank and it has been found to be advantageous to provide the perforations in the cylindrical shank only in the region of the central cylindrical portion of the roving package.

The cotton or other short-staple roving from the flyer is thus supplied to the dyeing step already on sleeves or cores which are suitable for carrying out the dyeing and on which the dyed roving package can remain when it is supplied to the spinning machine, especially a ring-spinning machine. Only the spun product or bobbin need be provided on a paper sleeve as is customary and this can be the bobbin produced by the spinning machine as is conventional.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
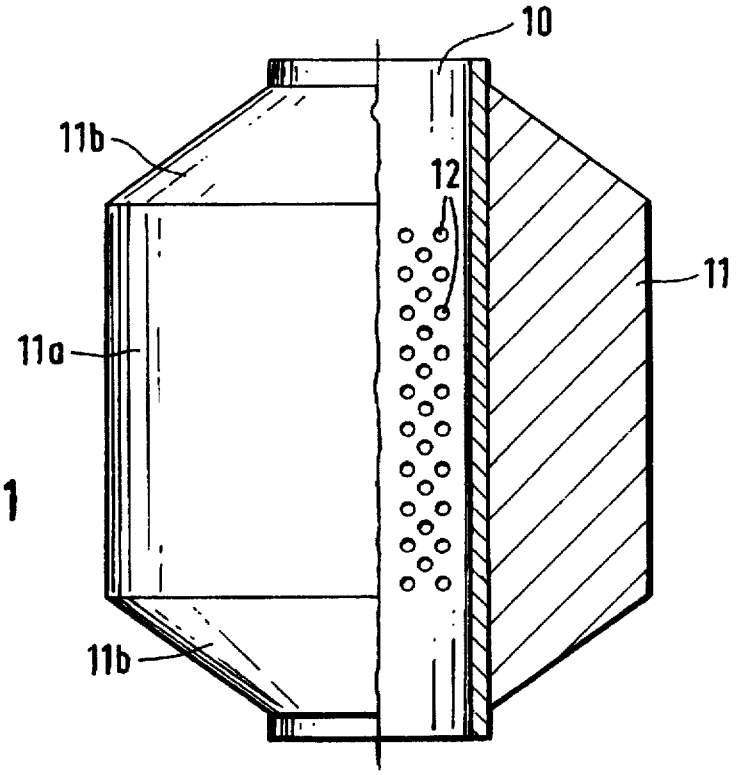
FIG. 1 is an elevational view of a roving package partly in section to show a perforated dyeing sleeve according to the invention.

In the drawing, FIG. 1 shows a cylindrical dyeing sleeve 10 carrying a short-staple fiber roving package 11 with a loose twist as formed by a flyer frame and wound upon the cylindrical dyeing sleeve 10 with a uniform winding density, i.e. a number of turns per unit length of the sleeve 10 and the package 11 which is as constant as is possible. The winding type is that which is generated as a so-called parallel winding for flyer bobbins with successive layers which are parallel to one another on the sleeve 10.

The sleeve 10 is provided with a multiplicity of perforations 12 through which the dye liquor can penetrate from the interior into the body 11, the dye being forced from the interior through the dye body or from the exterior through the dye body into the interior of the sleeve. While the perforations 12 are shown to be circular in the metal cylinder forming the sleeve 10, they may also be constituted as elliptical openings or slots elongated longitudinally or circumferentially.

The roving body 11 has a cylindrical central section or portion 11*a* and two conical or frustoconical end sections 11*b*. It has been found that best results are obtained by providing the perforations 12 so that they are located only in the region covered by the cylindrical central portion 11*a* of the roving package. This has been found to maintain an undisturbed lie of the terminal portions 11*b* following dyeing.

Figure 2:
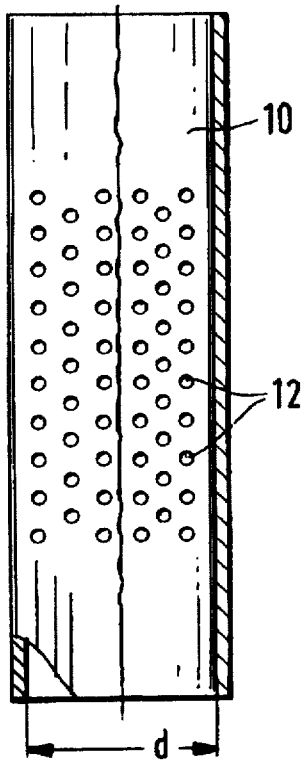
FIG. 2 is an elevational view of the dyeing sleeve itself, partially in section.

As will be apparent from FIG. 2, the sleeve 10 (until it is pressed over the sleeve 13) has an internal diameter d which is slightly smaller than the external diameter D of a conventional flyer sleeve 13 which thus can receive the sleeve 10 with a friction fit so that the latter can be thrust over the flyer sleeve 13 or withdrawn therefrom. The frictional engagement of the sleeve 10 by the flyer sleeve 13 is sufficient to enable transfer of rotation from the flyer sleeve to the sleeve 10 in forming the roving package 11.

As is conventional with the flyer sleeve 13, the latter can have a base provided with notches 13*b* for rotatably coupling the sleeve 13 to the spindle of the flyer frame. The opposite end of the sleeve 13 can be formed with the receiving cone 13*a* which allows a hanger to be accommodated and the flyer sleeve to be mounted on and removed from hangers upon introduction of the empty flyer sleeve into the flyer frame and the removal of full flyer bobbins from the latter.

Figure 3:
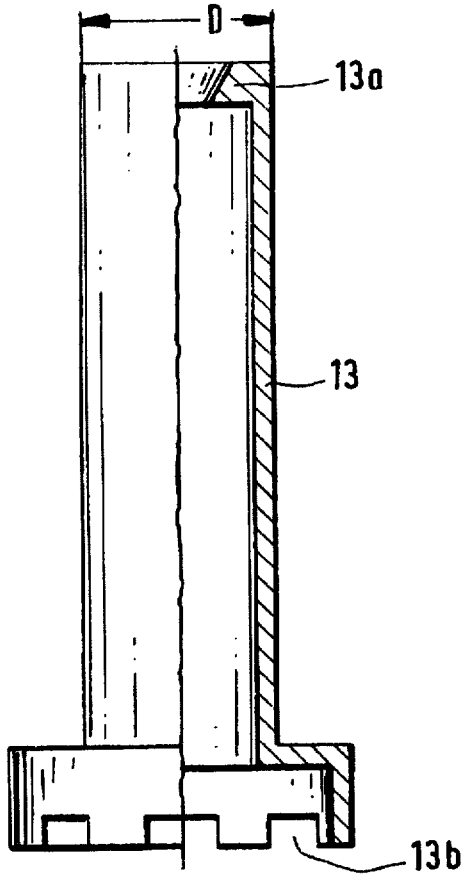
FIG. 3 is an elevational view of a conventional flyer sleeve adapted to receive the dyeing sleeve, also partially in axial section.

In the embodiments of FIGS. 1–3, therefore, the flyer sleeve 10 forms an adapter for allowing the roving package 11 to be built on a conventional flyer sleeve and, upon removal therefrom, to serve as a support for the yarn package 11 as a dyeing sleeve in a conventional dyeing apparatus.

Figure 4:
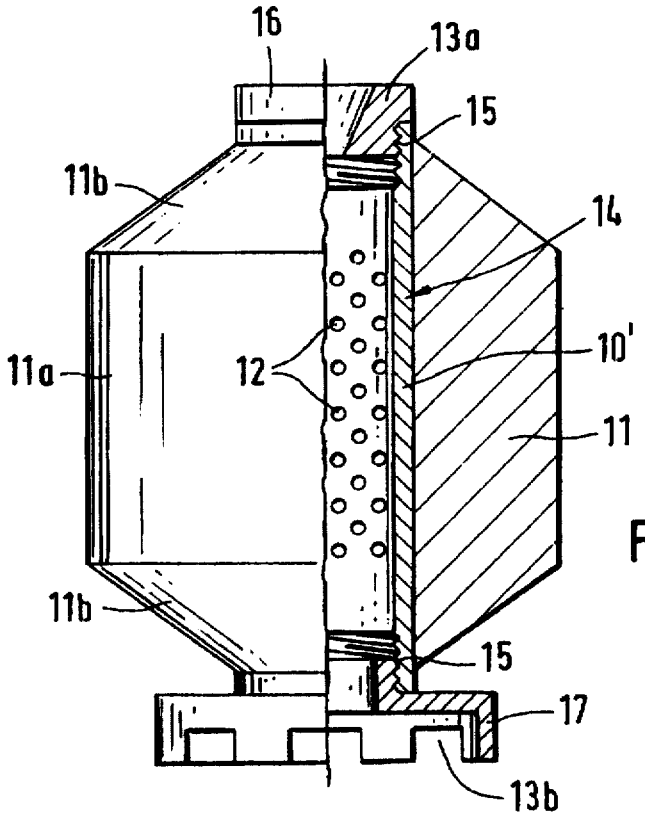
FIG. 4 is a view similar to FIG. 1 of an assembly in which the roving package is formed directly on a flyer dyeing sleeve.

FIG. 4 shows another embodiment in which the carrier for the roving body 11 is in the form of a combined flyer dyeing sleeve 14. In this case, a perforated central cylindrical tubular member 10' forms a dyeing sleeve as has been described in connection with FIGS. 1 and 2 but which has at its ends coupling means 15, e.g. screw threads, for releasable attachment of a head 16 formed with the conical structure 13*a*, and a base 17 with the notches 13*b* for rotatable coupling to the flyer sleeve.

Figure 5:
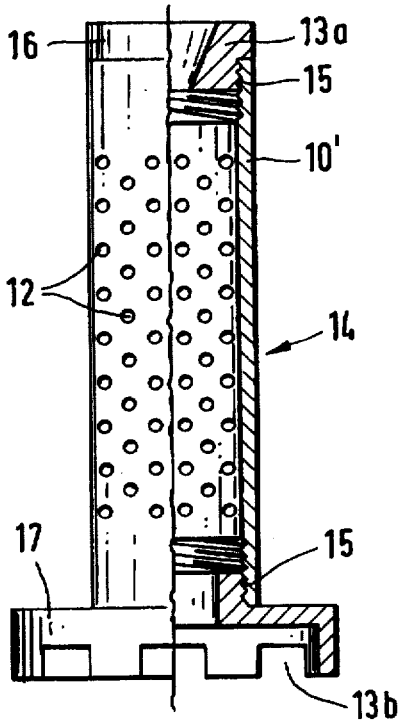
FIG. 5 is a view of a flyer dyeing sleeve according to the invention in elevation in partial axial section.
Figure 6:
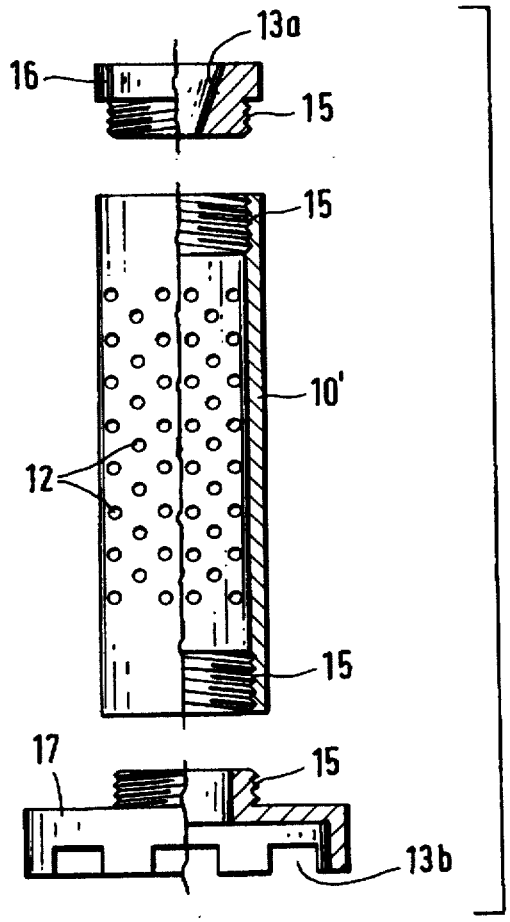
FIG. 6 is an exploded view of the sleeve of FIG. 5 showing the head and base as separated from the tubular portion thereof.

In the embodiment of FIGS. 4–6, the members 16 and 17 have external screw threads which can be threaded onto the internal screw threads forming the coupling means 15 of the sleeve 10'. When the members 16 and 17 are in place, the roving package 11 can be built in the flyer frame from the flyer slubbing with a slight twist, while with removal of these members (see FIG. 6), the sleeve 10' can be introduced into a conventional dyeing machine for the dyeing of the roving package.

Figure 7:
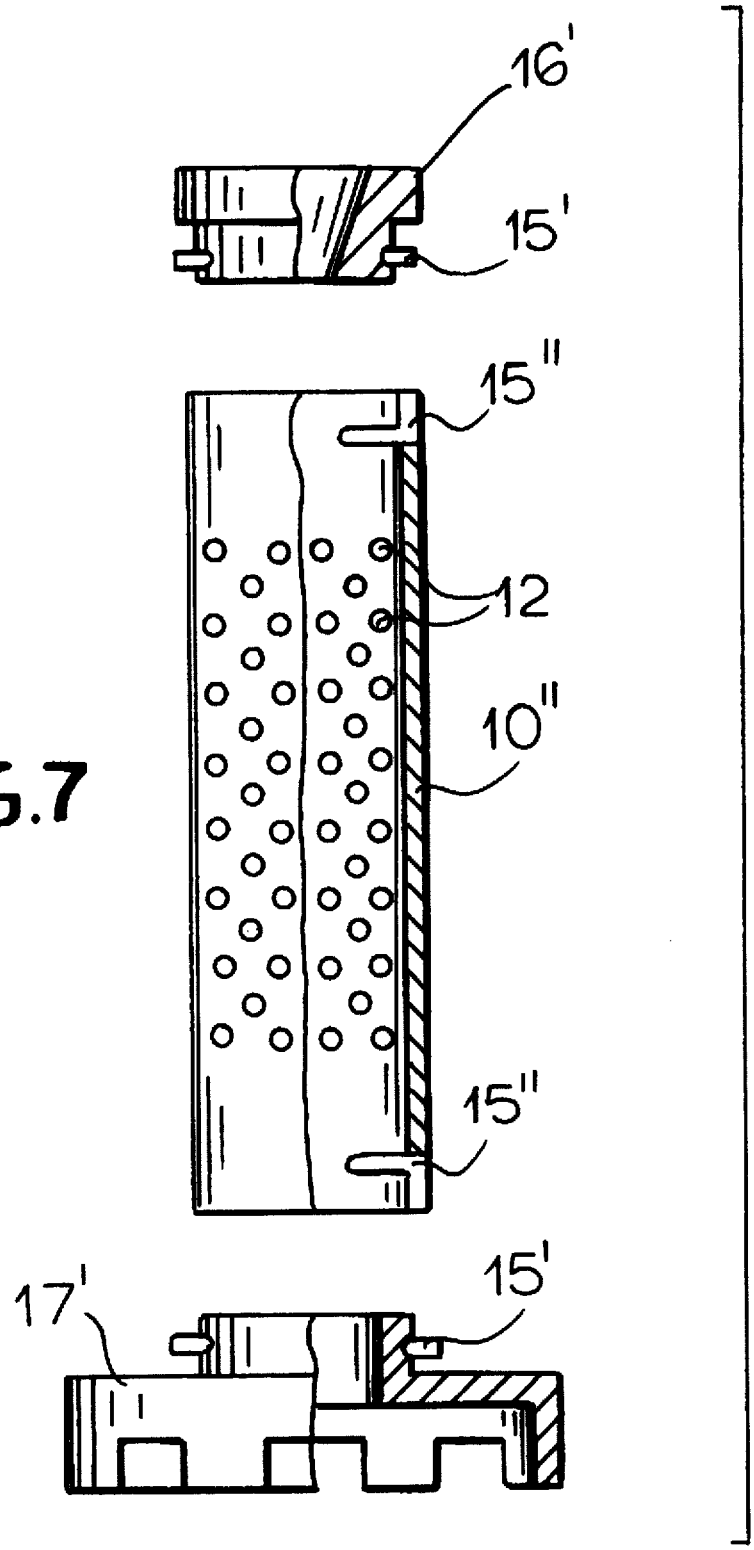
FIG. 7 is a view similar to FIG. 6 showing the coupling between the parts in the form of a bayonet connection.

FIG. 7 shows an embodiment similar to that of FIG. 6 but with the coupling of members 16' and 17' to the sleeve 10' via bayonet connections formed by pins 15' on the head 16' and the base 17', and bayonet slots 15" formed in the sleeve 10" and receiving the pins.

We claim:

1. A method of producing colored short staple-fiber yarn, comprising the steps of:

(a) providing a sliver of at least one fiber selected from the group which consists of short staple fiber cotton, synthetics or blends thereof;

(b) flyer-winding said sliver into a flyer roving and winding the roving in a roving body with a uniform turn density on a perforated dyeing sleeve;

(c) dyeing said roving body by passing a dyestuff through said roving body and perforations in said sleeve; and (d) directly following the dyeing of said roving body spinning the flyer roving into a yarn on a spinning machine.

2. The method defined in claim 1 wherein said sliver receives a twist count of substantially 40 to 60 turns per meter in forming said flyer roving in step (b).

3. The method defined in claim 2 wherein said sliver receives a twist count of substantially 50 to 55 turns per meter in forming said flyer roving in step (b).

4. The method defined in claim 1 wherein said sliver is wound in step (b) in a flyer roving frame directly upon a flyer sleeve forming said dyeing sleeve in forming said roving body.

* * * * *